US009756988B2

(12) United States Patent
Beuhring et al.

(10) Patent No.: US 9,756,988 B2
(45) Date of Patent: Sep. 12, 2017

(54) GRAVITY SHOWER

(71) Applicant: Haws Corporation, Sparks, NV (US)

(72) Inventors: Micah Benjamin Beuhring, Reno, NV (US); Donald Marshall, Reno, NV (US)

(73) Assignee: HAWS CORPORATION, Sparks, NV (US)

( * ) Notice: Subject to any disclaimer, the term of this patent is extended or adjusted under 35 U.S.C. 154(b) by 122 days.

(21) Appl. No.: 14/519,102

(22) Filed: Oct. 20, 2014

(65) Prior Publication Data

US 2016/0106270 A1 Apr. 21, 2016

(51) Int. Cl.
*A47K 3/28* (2006.01)

(52) U.S. Cl.
CPC ..... *A47K 3/286* (2013.01); *A47K 3/288* (2013.01)

(58) Field of Classification Search
CPC ..... A47K 3/286; A47K 3/288
USPC ..... 4/602
See application file for complete search history.

(56) References Cited

U.S. PATENT DOCUMENTS

| | | | |
|---|---|---|---|
| 4,364,133 | A | 12/1982 | Gunter |
| 5,012,536 | A | 5/1991 | Rivera |
| 6,711,758 | B1 | 3/2004 | Terek et al. |
| 8,316,478 | B2 | 11/2012 | Strandberg et al. |
| 8,566,974 | B2 | 10/2013 | Strandberg et al. |
| 8,747,374 | B2 | 6/2014 | Strandberg et al. |
| 8,839,468 | B2 | 9/2014 | Strandberg et al. |
| 2005/0086738 | A1 | 4/2005 | Gragtmans |
| 2012/0096639 | A1 | 4/2012 | Stanley et al. |
| 2012/0260417 | A1 | 10/2012 | LeBlanc |

FOREIGN PATENT DOCUMENTS

| | | | |
|---|---|---|---|
| DE | 8706523 | U1 | 7/1987 |
| EP | 2135536 | A1 | 12/2009 |

OTHER PUBLICATIONS

International Search Report and Written Opinion as issued in corresponding Application No. PCT/US2015/056528, dated Jan. 11, 2016.

*Primary Examiner* — Tuan N Nguyen
(74) *Attorney, Agent, or Firm* — Alston & Bird LLP

(57) ABSTRACT

Embodiments provide a stand-alone or self-contained gravity-fed emergency shower including a shower head. A water-tight reservoir is provided, the reservoir including an outlet in fluid communication with a shower head, and an air inlet pipe. The air inlet pipe includes an interior end and an exterior end, the interior end extending into the reservoir to a point below the fill level and above the outlet. The air inlet pipe allows air to enter the reservoir as water drains through the outlet, maintaining a substantially constant head pressure at the outlet, thereby resulting in a substantially constant flow rate of water to the shower head.

19 Claims, 9 Drawing Sheets

GRAVITY SHOWER

FIELD OF THE INVENTION

Exemplary embodiments relate generally to gravity-fed showers designed to release a flow of water under the influence of gravity to enable a user to wash his body or parts of his body.

BACKGROUND

Certain emergency showers are installed in laboratory and/or industrial applications where personnel may need to wash or flush toxic substances from their bodies in situations where a constant source of water is not readily available. Typically, these showers include a reservoir and either provide water pressure using a pump or through the use of gravity. The reservoir-based emergency showers that use a pump to create a relatively constant pressure and hence flow, require power that is typically obtained from a battery or gasoline-driven generator in remote areas or from typical power outlets in less remote areas.

Known gravity-fed reservoir-based emergency showers rely on head pressure, that is, the pressure created by the weight of the water above the shower head. One problem with known gravity-fed showers is their inability to maintain a substantially constant flow rate during the entire period of use. When a known shower is initially activated for use, the head pressure is relatively high due to the water in the reservoir. The high initial head pressure results in a flow rate of water and pressure through the shower head that is higher than desired. Also, as the shower reservoir drains during use, the head pressure decreases, resulting in a consequent undesirable decrease in the flow rate and pressure of the water through the shower head.

A varying flow rate during use is problematic especially for emergency usage as a sudden high initial flow rate may be unpleasant and even injurious to users, and as the emergency washing function becomes less effective with a decreasing flow rate. In certain cases, the flow rate of known gravity-fed showers may drop below about 20 gallons per minute during a time period of about 15 minutes, which is the minimum required flow rate for emergency showers for compliance with ANSI standards. In addition, due to the decreasing effectiveness of the water flow over time, an overall larger volume of water may be needed to complete the emergency needs of users. To compensate for this problem, certain conventional systems increase the volume of the water reservoir or supplement the reservoir with another source of water. In certain conventional systems, constant flow rate devices, such as constant flow rate valves that deliver a constant flow rate regardless of pressure within a predetermined range, are employed to address the issue of decreasing flow rate over time. However, known constant flow rate valves are not designed to control pressure, are not adjustable, require a minimum pressure differential across the valve, and tend to wear out.

SUMMARY

There exists a significant need for improvements in gravity showers, particularly with respect to providing a substantially constant flow rate of water during the entire period of use. Exemplary embodiments provide an improved gravity-fed shower configured to discharge a substantially constant flow rate of water from a reservoir during an entire time of use. An exemplary shower includes an air flow pipe provided in the reservoir that operates using the principles of a Mariotte bottle or siphon. As a result, even as the reservoir drains during use, a substantially constant head water pressure is maintained at an outlet of the reservoir, resulting in a substantially constant flow rate of water being discharged from the reservoir through the outlet.

The exemplary gravity-fed shower is advantageous for numerous reasons. The substantially constant flow rate of water discharged by the exemplary shower maintains an effective washing function throughout the duration of its use. Since the effectiveness of the shower does not decrease over time, unlike conventional showers, a smaller amount of water may be needed for a shower, and therefore a smaller reservoir may be sufficient. The exemplary shower is especially advantageous in use in emergency washing systems as it can consistently and reliably achieve a flow rate of about 20 gallons per minute for at least 15 minutes, in compliance with ANSI standards for emergency showers. As a result, the exemplary shower is well-suited for remote locations without a potable water supply or power, laboratories, research facilities and industrial facilities (e.g., mining, petro-chemical, bio-diesel and ethanol processing facilities) where a drench shower is required for flushing contaminants from user's bodies on an emergency basis.

In some embodiments, a complete shower including a reservoir, a shower head and a shower stall may be provided. In other embodiments, an exemplary reservoir may be provided for fitting onto a conventional shower head and shower stall. In yet other embodiments, an exemplary reservoir may be used without the need for a shower stall.

In accordance with an exemplary embodiment, a stand-alone or self-contained emergency shower is provided. The stand-alone or self-contained emergency shower may include a shower stall comprising a ceiling and three walls. The stand-alone or self-contained emergency shower preferably includes a shower head mounted in the shower stall, and is preferably arranged to be able to deliver water to a person positioned in the shower stall. The exemplary stand-alone or self-contained emergency shower preferably includes a water-tight reservoir mounted above and/or forming the ceiling of the shower stall. The water-tight reservoir includes an air-tight sealable fluid inlet, an outlet, and an air inlet pipe. The outlet of the water-tight reservoir is positioned below the bottom of the air inlet pipe. The outlet is in fluid communication with the shower head.

The exemplary stand-alone or self-contained emergency shower also includes a valve between the shower head and the outlet of the water-tight reservoir. The valve is preferably opened using a standard emergency shower pull chain or a pull rod with a handle.

The arrangement of the air inlet pipe and the outlet allows air to enter the reservoir as the water in the reservoir flows from the outlet to the shower head, maintaining a substantially constant water pressure and a substantially constant flow rate to the shower head without the need for pumps or complicated constant flow rate valves.

The air inlet pipe of the water-tight reservoir includes an interior end and an exterior end, the interior end extending into the water-tight reservoir to a point lower than the fill level and higher than the outlet. In certain non-limiting embodiments, the exterior end of the air inlet pipe may extend through a top wall of the water-tight reservoir. In certain non-limiting embodiments, the exterior end of the air inlet pipe may extend through a side wall or a bottom wall of the water-tight reservoir. In certain non-limiting embodiments, a one-way check valve may be provided at the air inlet pipe so that water is prevented from flowing back through the air inlet pipe.

When the valve between the shower head and the outlet of the water-tight reservoir is in a closed state and the fluid inlet is sealed, the air inlet pipe is the only fluid conduit between an interior of the water-tight reservoir and an exterior of the water-tight reservoir. The air inlet pipe allows air to enter the reservoir as water drains through the outlet, thereby maintaining a substantially constant water pressure at the outlet and resulting in a substantially constant flow rate to the shower head.

In accordance with another exemplary embodiment, a self-contained emergency shower is provided. The self-contained emergency shower includes a shower stall comprising a tank supporting framework and a water-tight reservoir mounted on the tank supporting framework. The water-tight reservoir includes an air-tight sealable fluid inlet port, a fill level, a fluid outlet having fluid outlet interior end and a fluid outlet exterior end, and an ambient air inlet pipe, the fluid outlet interior end positioned below the fill level, and the fluid outlet exterior end in fluid communication with a shower head. The self-contained emergency shower also includes a valve located between the shower head and the fluid outlet exterior end, and a valve operating mechanism for opening and closing the valve. The ambient air inlet pipe of the water-tight reservoir includes an interior end and an exterior end, the interior end extending into the water-tight reservoir to a point lower than the fill level and higher than the fluid outlet interior end. When the valve is in a closed state and the fluid inlet port is sealed, the ambient air inlet pipe is the only fluid conduit between the interior of the water-tight reservoir and the exterior of the water-tight reservoir.

In accordance with another exemplary embodiment, a stand-alone emergency shower is provided. The stand-alone emergency shower includes shower stall comprising a ceiling and three walls, and a shower head mounted in the shower stall, the shower head arranged to be able to deliver water to a person positioned in the shower stall. The stand-alone emergency shower also includes a water-tight reservoir having an interior mounted above the shower stall, the water-tight reservoir including an air-tight sealable fluid inlet port, a fill level, an outlet port and an ambient air inlet pipe, the outlet port positioned below than the fill level and higher than the shower head, and a tube connecting the outlet port to the shower head. The stand-alone emergency shower also includes a valve connected to the tube and located between the shower head and the outlet port of the water-tight reservoir, the valve positioned below than the outlet port, and a valve operating mechanism for opening and closing the valve, the valve operating mechanism located in relation to the shower stall such that a person positioned in the shower stall can open and close the valve using the valve operating mechanism. The ambient air inlet pipe of the water-tight reservoir includes an interior end and an exterior end, the interior end extending into the water-tight reservoir to a point below than the fill level and above the outlet port. When the valve is in a closed state and the fluid inlet port is sealed, the ambient air inlet pipe is the only fluid conduit to the interior of the water-tight reservoir.

In accordance with another exemplary embodiment, a stand-alone emergency shower is provided. The stand-alone emergency shower includes a tank, the tank having an interior, one or more sides, a top and a bottom, and including a shower head, an air-tight sealable fluid inlet port, an outlet port and an ambient air inlet pipe, the outlet port positioned below the top of the tank and higher than the shower head, the outlet port in fluid communication with the shower head. The stand-alone emergency shower also includes a valve located between the shower head and the outlet port of the tank, the valve positioned lower than the outlet port, and a valve operating mechanism for opening and closing the valve. The ambient air inlet pipe of the tank includes an interior end and an exterior end, the interior end extending into the tank to a point below the top of the tank and higher than the outlet port. When the valve is in a closed state and the fluid inlet port is sealed, the ambient air inlet pipe is the only fluid inlet to the interior of the tank

BRIEF DESCRIPTION OF THE DRAWINGS

The foregoing and other objects, aspects, features, and advantages of exemplary embodiments will become more apparent and may be better understood by referring to the following description taken in conjunction with the accompanying drawings.

The accompanying drawings are not intended to be drawn to scale.

DETAILED DESCRIPTION

Some exemplary embodiments of the present invention will now be described more fully hereinafter with reference to the accompanying drawings in which some, but not all, embodiments of the inventions are shown. Indeed, these inventions may be embodied in many different forms and should not be construed as limited to the embodiments set forth herein. Like numbers refer to like elements throughout.

Figure 1:
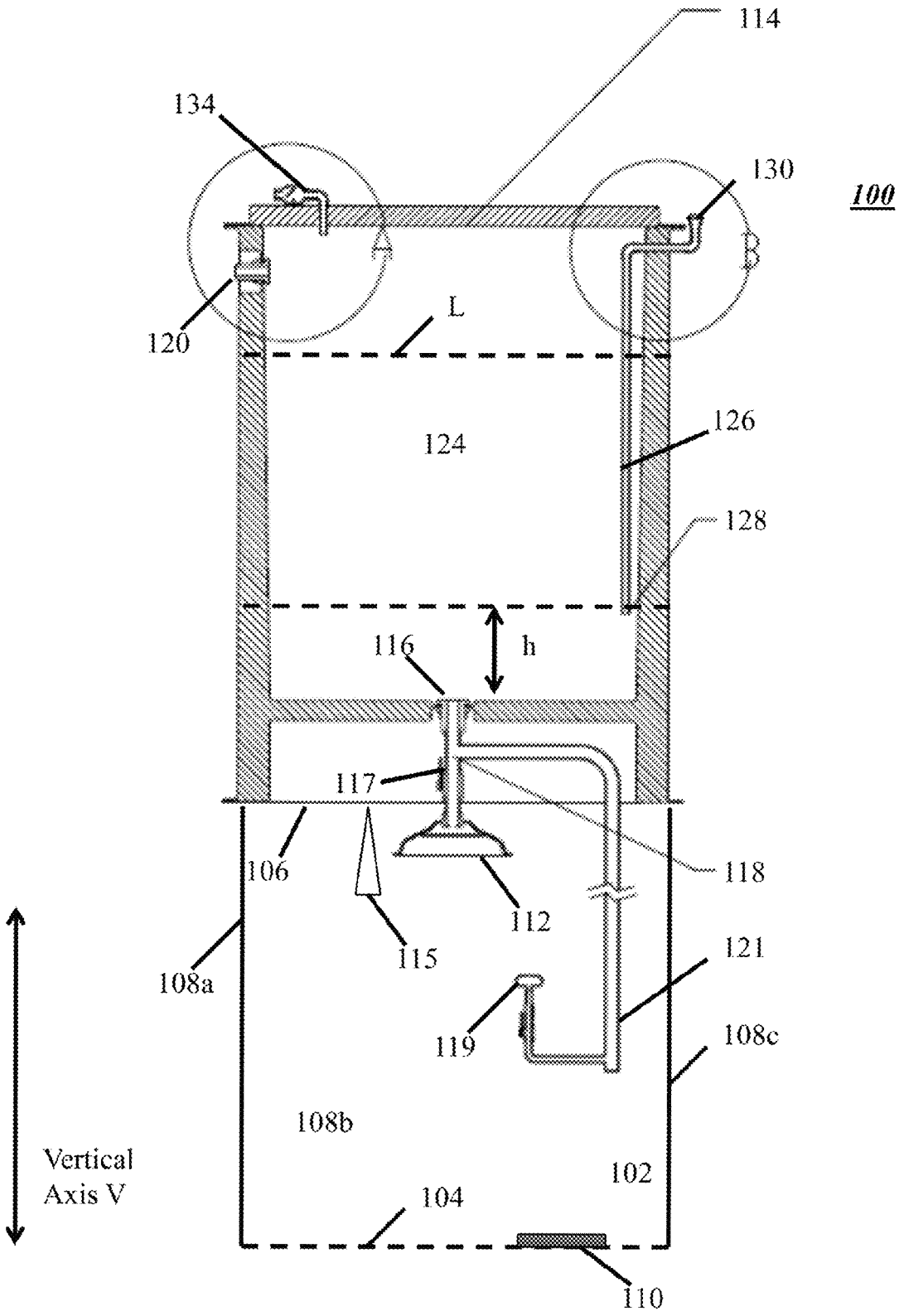
FIG. 1 illustrates a cross-sectional side view of an exemplary gravity-fed shower including a reservoir provided in accordance with an exemplary embodiment.
Figure 2:
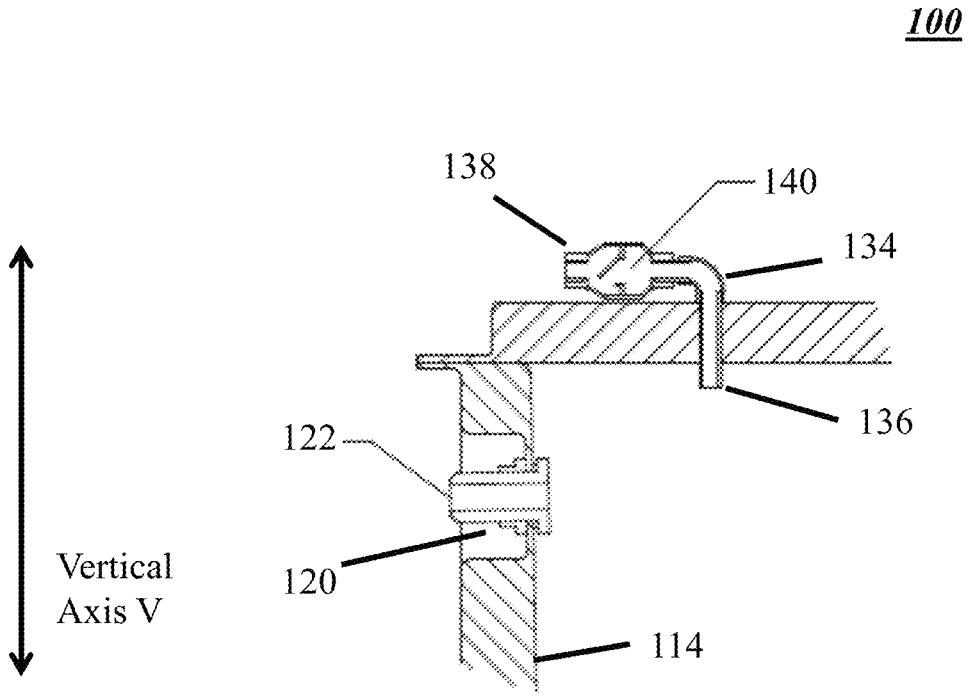
FIG. 2 illustrates a close-up view of portion A of FIG. 1.
Figure 3:
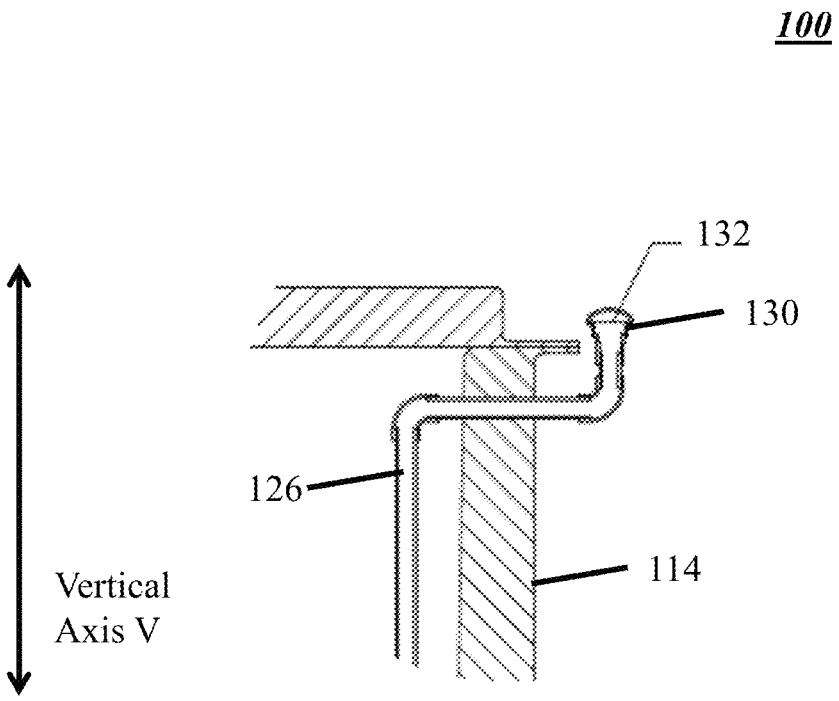
FIG. 3 illustrates a close-up view of portion B of FIG. 1.

FIG. 1 illustrates a cross-sectional side view of an exemplary stand-alone or self-contained gravity-fed emergency shower 100 provided in accordance with an exemplary embodiment. FIG. 2 illustrates a close-up view of portion A of FIG. 1. FIG. 3 illustrates a close-up view of portion B of FIG. 1.

In some embodiments, the stand-alone or self-contained gravity-fed emergency shower 100 may include a shower stall 102 configured and dimensioned to accommodate a person within its boundaries. The shower stall 102 includes a reservoir or tank support framework. In one exemplary non-limiting embodiment, the reservoir or tank support framework of the shower stall 102 may include a floor 104 as its bottom surface, a ceiling 106 as its top surface, and walls 108*a-c* as its side surfaces. In some embodiments, the reservoir or tank support framework of the shower stall 102 may have two, three or four walls. In some non-limiting embodiments, the floor 104 may include a drain 110 for drainage of water out of the shower stall 102. In some embodiments, the reservoir or tank support framework of the shower stall 102 may not include a floor 104 or a drain 110. In some embodiments, the reservoir or tank support framework of the shower stall 102 may include a door as a fourth side surface. In some embodiments, the shower stall 102 may include a shower curtain.

In certain embodiments, the stand-alone or self-contained gravity-fed emergency shower 100 includes a shower head 112 mounted in the shower stall 102. The shower head 112 is arranged and positioned to be able to deliver a flow of water to a person standing in the shower stall 102. Although the shower head 112 is represented as being positioned at the ceiling 106 of the shower stall 102, the shower head 112 may enter the shower stall 102 through a side wall 108*a-c* in other embodiments. In certain exemplary non-limiting embodiments, the internal diameter of the shower head 112 ranges from about 0.1 inches to about 2.5 inches, but is not limited to this exemplary range. In certain non-limiting examples, the internal diameter of the shower head 112 is about 0.5, 0.6, 0.7, 0.8, 0.9, 1, 1.1, 1.2, 1.3, 1.4, 1.5 inches, and the like. Details of an exemplary shower head and associated components that may be used in a gravity-fed shower described herein can be found in U.S. Pat. No. 8,316,478, issued Nov. 27, 2012, titled "Emergency Eyewash Unit;" U.S. Pat. No. 8,566,974, issued Oct. 29, 2013, titled "Emergency Eyewash Unit;" U.S. Pat. No. 8,747,374, issued Jun. 10, 2014, titled "Emergency Eyewash Unit;" and co-pending U.S. Patent Publication No. 2014/0047633, published Feb. 20, 2014, titled "Emergency Eyewash Unit." The entire contents of each of the patent publications referenced above are expressly incorporated herein by reference.

The stand-alone or self-contained gravity-fed emergency shower 100 includes a water-tight reservoir or tank 114 configured and dimensioned to hold a desired volume of water. In one exemplary embodiment, the water-tight reservoir or tank 114 may have an interior space with one or more sides (four sides in one example), a top surface and a bottom surface. The shower head 112 is in direct or indirect (through one or more additional components) fluid communication with the water-tight reservoir or tank 114. Upon filling, the water-tight reservoir or tank 114 contains a volume of water 124 having a fill level or height, L, which is measured from the bottom surface of the water-tight reservoir or tank 114 to the top surface of the water in the water-tight reservoir or tank 114 along the vertical axis V. The fill level or height, L, is designated depending on the volume of water desired in the reservoir. The water-tight reservoir or tank 114 may be mounted above the ceiling 106 of the shower stall 102, and/or the bottom surface of the water-tight reservoir or tank 114 may form the ceiling of the shower stall 102 in some embodiments. The water-tight reservoir or tank 114 may be formed of any suitable material that can withstand any vacuum or negative pressures generated within the water-tight reservoir including, but not limited to, molded plastic and steel such as stainless steel which has anti-corrosive properties.

The exemplary water-tight reservoir or tank 114 illustrated in FIG. 1 is box-shaped with a rectangular cross-sectional profile. Water-tight reservoirs of other cross-sectional shapes and other structural designs may be used in other embodiments. In some cases, a suction or vacuum pressure may be generated within the water-tight reservoir or tank 114 as water drains out during use of the shower, creating a risk of the water-tight reservoir walls collapsing inward. In one embodiment, a substantially box-shaped reservoir may be used, as illustrated in FIGS. 1-3. In another embodiment, a substantially cylindrical reservoir may be used. In another embodiment, a substantially spherical reservoir may be used.

In one embodiment, the water-tight reservoir or tank 114 includes a fluid outlet 116 having an interior end that is positioned below a fill level, L, of the water-tight reservoir or tank 114 and an exterior end that is in fluid communication with the shower head 112 via one or more pipes or tubes 118. In certain embodiments, the fluid outlet 116 may be attached or connected to a bottom surface of the water-tight reservoir or tank 114. In one embodiment illustrated in FIG. 1, the pipe 118 extends downward from the fluid outlet 116 to the shower head 112. In another embodiment, the pipe 118 may be configured as a siphon so that it extends from the fluid outlet 116 upward to a position above the fill level, L, and then downward to the shower head 112. In certain exemplary non-limiting embodiments, the internal diameter of the fluid outlet 116 ranges from about 0.5 inch to about 2.5 inches, but is not limited to this exemplary range. In certain non-limiting examples, the internal diameter of the fluid outlet 116 is about 1, 1.1, 1.2, 1.3, 1.38, 1.4, 1.5, 1.6, 1.7, 1.8, 1.9, 2 inches, and the like.

A valve 117 is provided between the shower head 112 and the exterior end of the fluid outlet 116. In one embodiment, the valve 117 may be formed of steel, such as stainless steel which has anti-corrosive properties. The valve 117 may be a ball valve in some embodiments. A valve operating mechanism 115, such as a pull chain or a pull rod with a handle, is provided for opening and closing the valve 117. In certain embodiments in which the stand-alone or self-contained gravity-fed emergency shower 100 includes a shower stall 102, the valve operating mechanism 115 is located in relation to the shower stall 102 such that a person standing in the shower stall 102 can operate the valve operating mechanism 115 to open and close the valve 117.

Figure 5A:
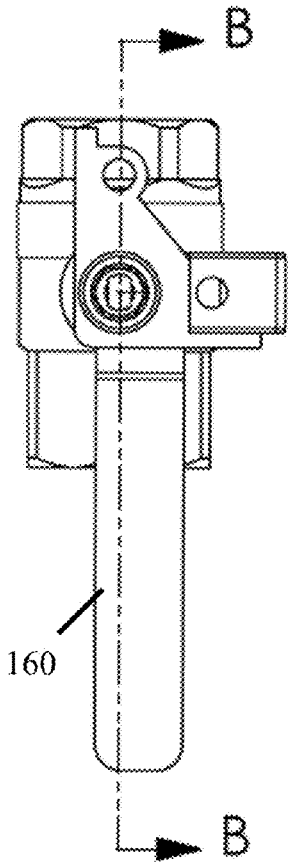
FIG. 5A illustrates a side view of a ball valve that may be used at an outlet of the reservoir shown in FIG. 1.
Figure 5B:
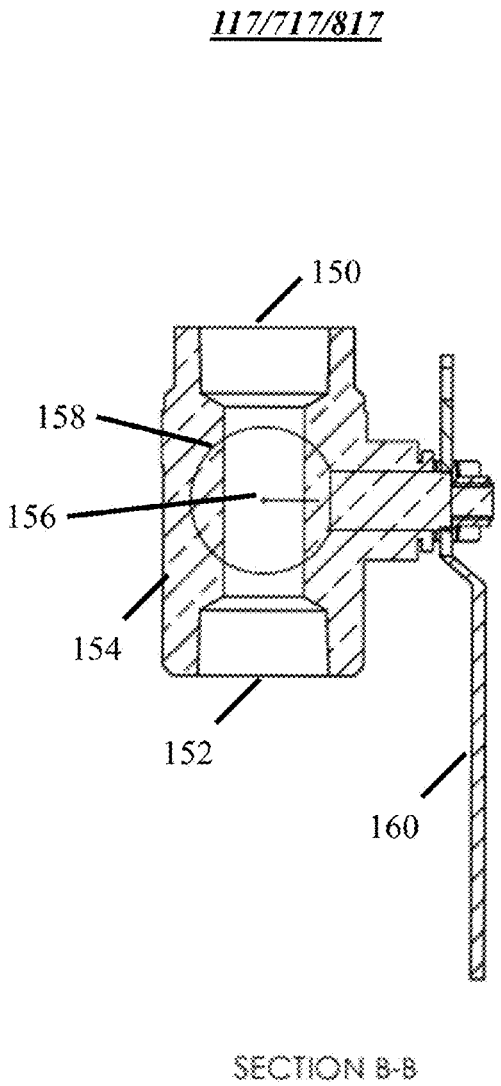
FIG. 5B illustrates a sectional side view taken along section B-B of FIG. 5A.

FIGS. 5A and 5B illustrate a side view of an exemplary valve 117 that is configured as a ball valve having an internal space that is machined out of the center of the valve body. FIG. 5A illustrates a side view of a ball valve 117 that may be used at an outlet of the reservoir shown in FIG. 1. FIG. 5B illustrates a sectional side view taken along section B-B of FIG. 5A.

The valve 117 includes a fluid inlet 150 in fluid communication with the fluid outlet 116, for example, by direct connection to the fluid outlet 116 or via the pipe 118. The valve 117 also includes a fluid outlet 152 in fluid communication with the shower head 112, for example, by direct connection to the shower head 112 or via the pipe 118. The valve 117 includes a valve body 154 having a hollow central space 156 that is machined from the center of the valve body 154. The central space 156 accommodates a ball 158 that may be turned to block the central space 156 so that water cannot flow through it (closed position) or to open up the central space 156 so that water can flow through it (open position). The valve 117 may include a lever or handle 160 that may be used to turn the ball 158 to switch the valve between the open and closed positions. In the closed position of the valve 117, the seal created by the ball 158 against the valve body 154 creates a water-tight barrier or seal between the fluid inlet 150 and the fluid outlet 152 of the valve 117, thereby preventing water from being released from the fluid outlet 116 to the shower head 112. On the other hand, when the valve 117 is in the open position, the central space 156 is fully or partly un-occluded or unblocked, so that water can flow from the fluid inlet 150 to the fluid outlet 152 of the valve 117, thereby allowing water to be discharged from the fluid outlet 116 to the shower head 112.

Returning to FIG. 1, the water-tight reservoir or tank 114 also includes an air-tight sealable fluid inlet 120 configured and dimensioned to allow the water-tight reservoir or tank 114 to be filled. In an alternative embodiment, the air-tight sealable fluid inlet 120 can be a removable cover of the water-tight reservoir or tank 114. In this embodiment, a rubber gasket is located between the walls and the removable cover of the water-tight reservoir or tank 114, and appropriate fasteners are used to secure the removable cover to the water-tight reservoir or tank 114. After the water-tight reservoir or tank 114 is filled, the air-tight sealable fluid inlet 120 is sealed to prevent leakage of air through the air-tight sealable fluid inlet 120. In one embodiment illustrated in FIG. 2, an air-tight ball valve 122 is provided at the air-tight sealable fluid inlet 120 to seal the air-tight sealable fluid inlet 120.

The stand-alone or self-contained gravity-fed emergency shower 100 includes an air inlet pipe 126 having an interior end 128 extending into the water-tight reservoir or tank 114 and an exterior end 130 extending outside the water-tight reservoir or tank 114. The air inlet pipe 126 is configured and dimensioned to accommodate air flow into the interior of the water-tight reservoir or tank 114 from the exterior of the water-tight reservoir or tank 114 when the valve 117 is open. The exterior end 130 of the air inlet pipe 126 is positioned higher than the fill level, L, in the water-tight reservoir or tank 114. In one embodiment illustrated in FIG. 3, a vented cap 132 is attached to the exterior end 130 of the air inlet pipe 126 to prevent outside particulates from entering the water-tight reservoir or tank 114. In certain exemplary non-limiting embodiments, the internal diameter of the air inlet pipe 126 ranges from about 0.1 inches to about 2 inches, but is not limited to this exemplary range. In certain non-limiting examples, the internal diameter of the air inlet pipe 126 is about 0.1, 0.2, 0.3, 0.4, 0.5, 0.6, 0.7, 0.8, 0.9, 1 inch, and the like. In certain exemplary non-limiting embodiments, the length of the air inlet pipe 126 ranges from about 20 inches to about 70 inches, but is not limited to this exemplary range. In certain non-limiting examples, the length of the air inlet pipe 126 is about 30, 31, 32, 33, 34, 35, 36, 37, 38, 39, 40, 41, 42, 43, 44, 45, 46, 47, 48, 49, 50 inches, and the like.

The interior end 128 of the air inlet pipe 126 extends into the water-tight reservoir or tank 114 to a point lower than the fill level, L, and higher than the fluid outlet 116 of the water-tight reservoir or tank 114. The interior end 128 of the air inlet pipe 126 is preferably positioned a distance away from the fluid outlet 116 to avoid air being drawn directly into the shower head 112 when the valve 117 is open. In certain non-limiting embodiments, the interior end 128 of the air inlet pipe 126 may be spaced or separated from the fluid outlet 116 by an exemplary distance ranging from about 8 inches to about 11 inches, but is not limited to this exemplary range.

When the valve 117 is in a closed state and when the air-tight sealable fluid inlet 120 is sealed, the air inlet pipe 126 is the only fluid conduit between the interior of the water-tight reservoir or tank 114 and the exterior of the water-tight reservoir or tank 114. That is, in this situation, the water-tight reservoir or tank 114 is air-tight except for the air that enters the water-tight reservoir or tank 114 through the air inlet pipe 126.

The amount of head pressure and hence flow rate through the shower head 112 when the valve 117 is open is determined by the height difference, h, between the opening at the interior end 128 of the air inlet pipe 126 and the fluid outlet 116. In the configuration of FIG. 1, since the atmospheric pressure remains constant, the head pressure at the fluid outlet 116 also remains substantially constant until the water drops below the opening at the interior end 128 of the air inlet pipe 126, thus maintaining a substantially constant flow rate of water discharged from the water-tight reservoir or tank 114 through the fluid outlet 116, even as the water-tight reservoir or tank 114 drains during use of the shower without the need for a pump or a constant flow rate device or valve.

In some embodiments, the stand-alone or self-contained gravity-fed emergency shower 100 enables a user or manufacturer to adjust the flow rate of water discharged through the fluid outlet 116. Since the flow rate of water discharged through the fluid outlet 116 depends on the head pressure at the fluid outlet 116 relative to the interior end 128 of the air inlet pipe 126, and since this head pressure depends on the vertical distance or height between the interior end 128 and the fluid outlet 116, adjustment of the flow rate is enabled by enabling adjustment of the height In some embodiments, the water-tight reservoir or tank 114 includes an air outlet pipe 134 as an air escape vent that is attached or connected at either the ceiling or at a top portion of one of the surfaces of the water-tight reservoir or tank 114. The air outlet pipe 134 is preferably positioned as close as possible to the top surface of the water-tight reservoir or tank 114 and, in some cases, through the top surface to allow maximum filling of the water-tight reservoir or tank 114 and to minimize the size of the air pocket at the top of the water-tight reservoir or tank 114. As illustrated in FIG. 2, the air outlet pipe 134 includes an interior end 136 positioned higher than the fill level, L, and an exterior end 138 extending out of the water-tight reservoir or tank 114 higher than the fill level. A one-way check valve 140 is provided or attached at the air outlet pipe 134 to allow air flow from the interior of the water-tight reservoir or tank 114 to the exterior of the water-tight reservoir or tank 114 when water is introduced into the water-tight reservoir through the air-tight sealable fluid inlet 120. This helps establish a vacuum in the water-tight reservoir or tank 114 that is important in controlling the flow rate of the water out of the water-tight reservoir or tank 114. The one-way check valve 140 operates to prevent air flow from the exterior of the water-tight reservoir or tank 114 to the interior of the water-tight reservoir or tank 114, thus ensuring that the drainage of water through the fluid outlet 116 creates a suction effect within the water-tight reservoir or tank 114.

In certain non-limiting embodiments, the stand-alone or self-contained gravity-fed emergency shower 100 may include or be used in cooperation with an emergency eyewash apparatus 119 used to flush contaminants from the eyes of a user using the stand-alone or self-contained gravity-fed emergency shower 100. The emergency eyewash apparatus 119 is in fluid communication with the fluid outlet 116 of the water-tight reservoir or tank 114, for example, via one or more pipes 121 that are in fluid communication with the fluid outlet 116. In one example, when the valve 117 is in a closed state, the pipes 118 and 121 do not receive any water from the water-tight reservoir or tank 114 and, consequently, the shower head 112 and the eyewash apparatus 119 do not discharge any water to the user. When the valve 117 is in an open or activated state, water flows out of the water-tight reservoir or tank 114 through the fluid outlet 116 and into pipes 118 and 121, thereby enabling both the shower head 112 and the eyewash apparatus 119 to concurrently discharge water to the user. This enables the user of the stand-alone or self-contained gravity-fed emergency shower 100 to wash contaminants from both his body and his eyes at the same time.

In one embodiment, the emergency eyewash apparatus includes two water discharge ports configured to be directed upward along the vertical plane and to diverge from each other, thereby producing a pair of upwardly directed diverging water streams for inside-out flush flow of contaminants from the eyes. The inside-out flush flow flushes contaminants away from the inner corner of the eyes away from the lacrimal punctum and toward the outer corner of the eyes. In certain embodiments, the emergency eyewash apparatus may include one or more face wash discharge ports that produce a plurality of water streams for washing contaminants from the face.

Details of an exemplary emergency eyewash apparatus that may be used in a gravity-fed shower described herein can be found in U.S. Pat. No. 8,316,478, issued Nov. 27, 2012, titled "Emergency Eyewash Unit;" U.S. Pat. No. 8,566,974, issued Oct. 29, 2013, titled "Emergency Eyewash Unit;" U.S. Pat. No. 8,747,374, issued Jun. 10, 2014, titled "Emergency Eyewash Unit;" co-pending U.S. Patent Publication No. 2014/0047633, published Feb. 20, 2014, titled "Emergency Eyewash Unit;" and co-pending U.S. Patent Publication No. 2012/0096639, published Apr. 26, 2012, titled "Faucet Mounted Eyewash Unit." The entire contents of each of the patent publications referenced above are expressly incorporated herein by reference.

Prior to use of the exemplary stand-alone or self-contained gravity-fed emergency shower 100, the water-tight reservoir or tank 114 is filled with water via the air-tight sealable fluid inlet 120. During the filling process, the one-way check valve 140 allows air in the water-tight reservoir or tank 114 to escape via the air outlet pipe 134. After the water-tight reservoir or tank 114 is filled with water, the ball valve 122 is used to seal the air-tight sealable fluid inlet 120 to prevent drainage or leakage of water out of the water-tight reservoir or tank 114 through the air-tight sealable fluid inlet 120. At the same time, the one-way check valve 140 prevents air from entering the water-tight reservoir or tank 114, thus maintaining a suction or vacuum pressure within the water-tight reservoir or tank 114 when the water is drained. The amount of air within the water-tight reservoir or tank 114 before use is minimized or eliminated because the more air there is in the reservoir, the longer it takes to establish a vacuum in the reservoir during use. This is because air expands easily, so the more air there is in the reservoir, the more it can expand.

A user may activate the stand-alone or self-contained gravity-fed emergency shower 100 using the valve operating mechanism 115 to open the valve 117. Water from the water-tight reservoir or tank 114 is discharged through the fluid outlet 116 through the pipe 118 and into the shower head 112. The discharge of the water may increase the suction or vacuum pressure in the water-tight reservoir or tank 114 in certain situations, thus drawing in air into the water-tight reservoir or tank 114 through the exterior end 130 of the air inlet pipe 126 from the exterior of the water-tight reservoir or tank 114. The air inlet pipe 126 is the only means for ambient air to enter the water-tight reservoir or tank 114. The flow rate of water through the fluid outlet 116 is determined by the head pressure at the fluid outlet 116 relative to the interior end 128 of the air inlet pipe 126. In the configuration of FIG. 1, since the atmospheric pressure remains constant, the head pressure at the fluid outlet 116 also remains substantially constant, thus maintaining a substantially constant flow rate of water discharged from the water-tight reservoir or tank 114 through the fluid outlet 116.

The water-tight reservoir or tank 114 may have any desired volume as long as the total volume above the interior end 128 extending into the water-tight reservoir or tank 114 is at least about 345 gallons. One exemplary non-limiting volume of the water-tight reservoir or tank 114 is about 450 gallons.

The water-tight reservoir or tank 114 may have any desired physical dimensions as long as the reservoir can maintain its shape when subjected to internal vacuum or suction pressures. One exemplary non-limiting set of dimensions for a reservoir with a square cross-section is about 45 inches in width, 45 about inches in length and about 55 inches in height along the vertical axis. Exemplary dimensions for the reservoir may range from about 20 inches to about 100 inches, but are not limited to this exemplary range. For an exemplary reservoir with a square, rectangular or polygonal cross-section, exemplary dimensions may include 30, 31, 32, 33, 34, 35, 36, 37, 38, 39, 40, 41, 42, 43, 44, 45, 46, 47, 48, 49, 50, 51, 52, 53, 54, 55, 56, 57, 58, 59, 60, 61, 62, 63 inches, and the like.

The water-tight reservoir or tank 114 may be formed of any suitable material including, but not limited to, fiberglass, wood, steel, insulation, and the like.

In certain embodiments, the stand-alone or self-contained gravity-fed emergency shower 100 achieves a water flow rate of at least about 20 gallons per minute for the shower head 112 and a water flow rate of at least about 3 gallons per minute for the emergency eyewash apparatus 119. That is, the stand-alone or self-contained gravity-fed emergency shower 100 achieves a total water flow of at least about 23 gallons per minute in certain embodiments. These water flow rates are achieved and maintained continually and reliably for a time period of at least 15 minutes.

Figures 4A, 4B:
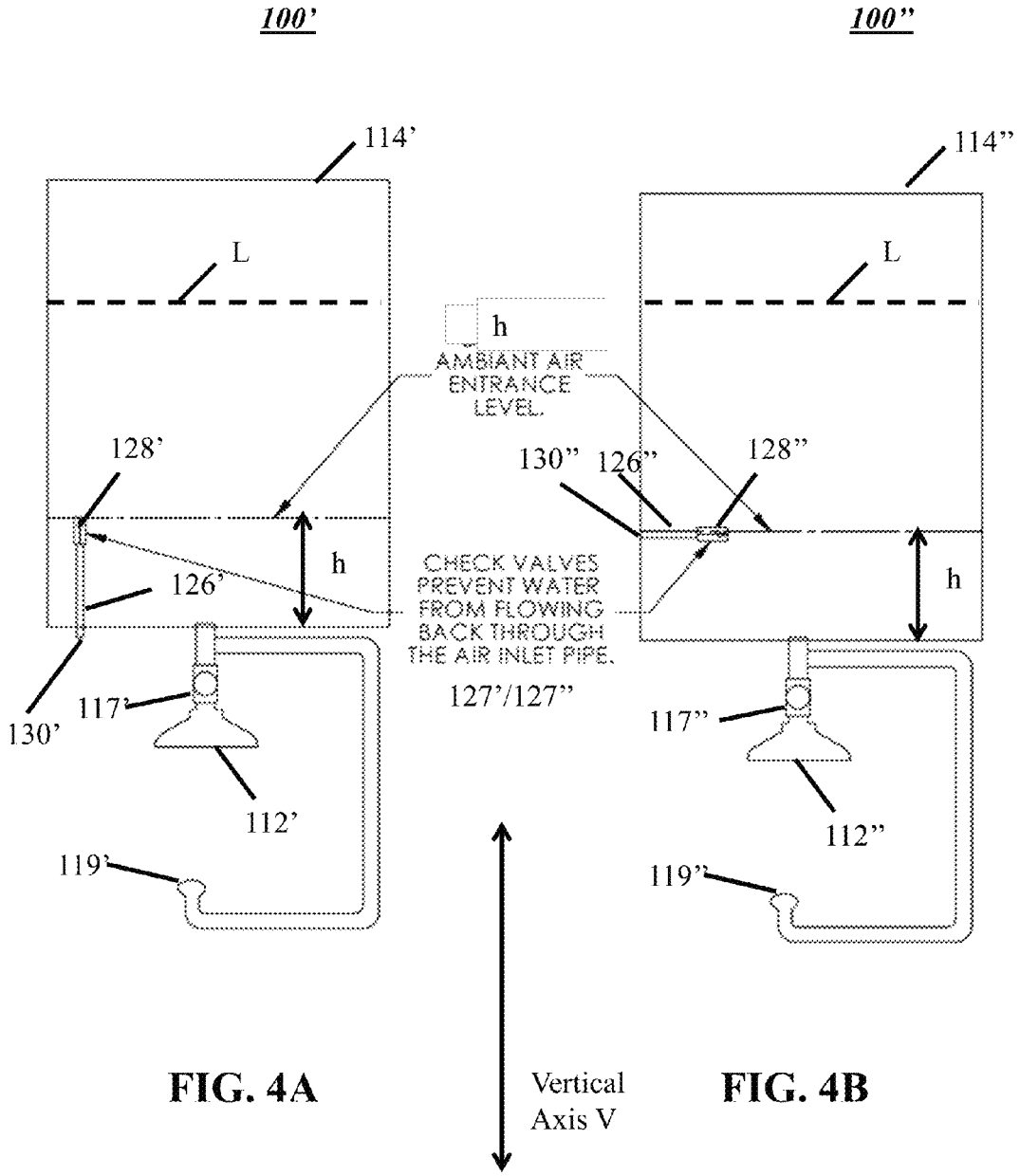
FIG. 4A illustrates a cross-sectional side view of an exemplary gravity-fed shower including a reservoir provided in accordance with an exemplary embodiment.
FIG. 4B illustrates a cross-sectional side view of an exemplary gravity-fed shower including a reservoir provided in accordance with an exemplary embodiment.

FIGS. 4A and 4B illustrate cross-sectional side views of exemplary gravity-fed showers, each including a reservoir in which the exterior end of the air inlet pipe is positioned lower than the interior end of the air inlet pipe along the vertical axis V. In the embodiment illustrated in FIG. 4A, the air inlet pipe 126' extends substantially vertically downward through a bottom wall of the reservoir or tank 114' such that the exterior end 130' of the air inlet pipe 126' is positioned below the bottom wall of the reservoir or tank 114' (i.e., below the interior end 128' of the air inlet pipe 126'). In this case, a one-way check valve may be provided at, for example, the interior end 128' of the air inlet pipe 126' to prevent water from flowing out through the air inlet pipe 126'.

In the embodiment illustrated in FIG. 4B, the air inlet pipe 126" extends substantially horizontally through a side wall of the reservoir or tank 114" such that the exterior end 130" of the air inlet pipe 126" is positioned substantially at the same height as the interior end 128" of the air inlet pipe 126"). In this case, a one-way check valve may be provided at, for example, the interior end 128" of the air inlet pipe 126" to prevent water from flowing out through the air inlet pipe 126".

Figure 6A:
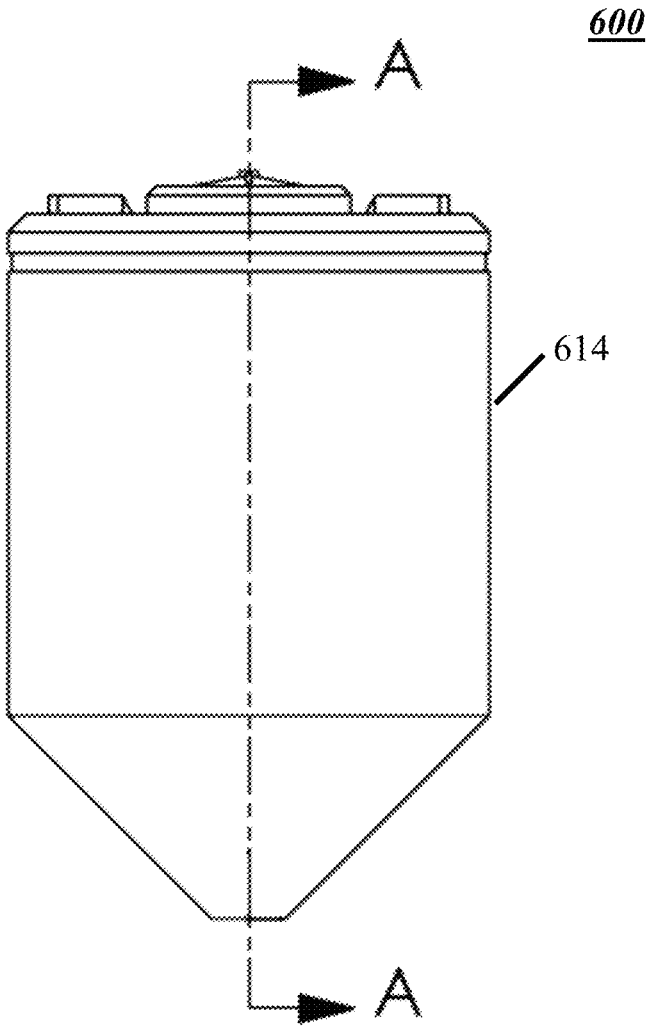
FIG. 6A illustrates a side view of an exemplary reservoir provided in accordance with another exemplary embodiment.
Figure 6B:
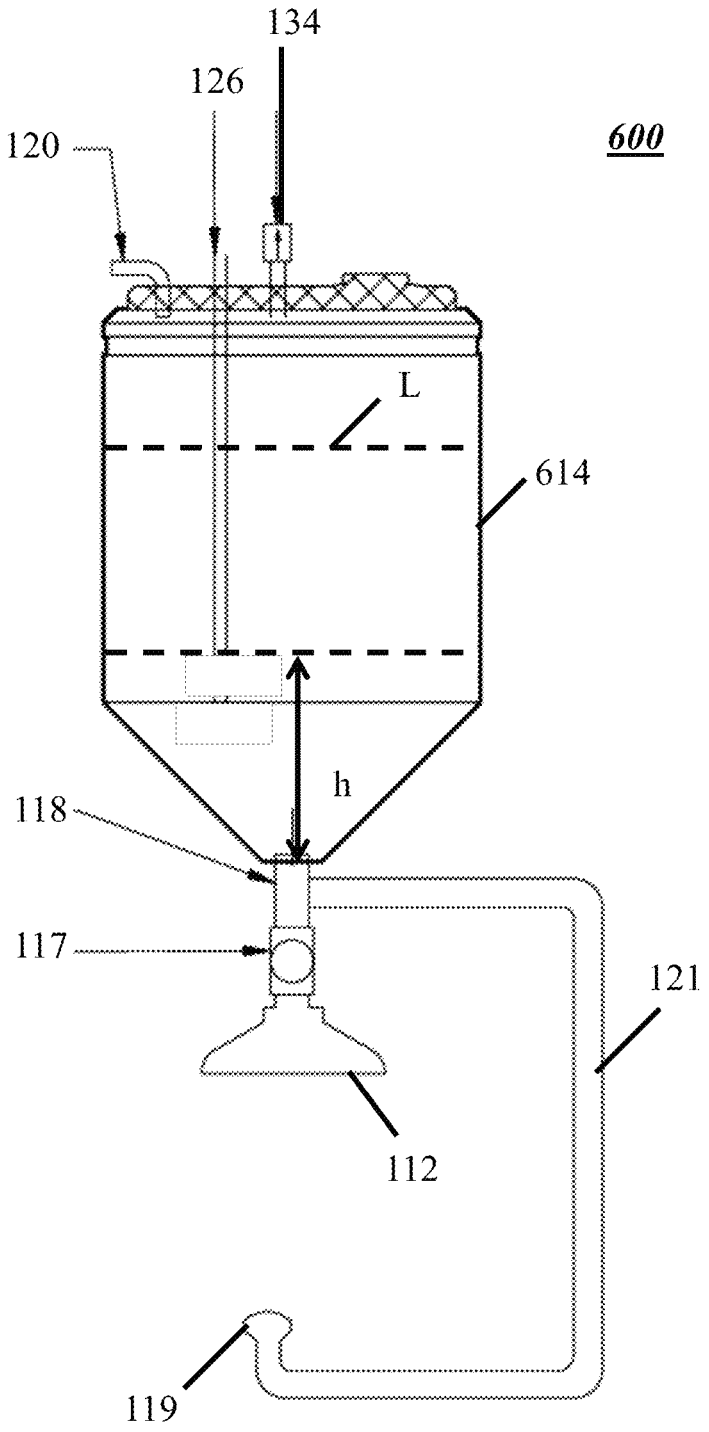
FIG. 6B illustrates a cross-sectional side view of an exemplary gravity-fed shower including the reservoir of FIG. 6A, showing a section taken along A-A of FIG. 6A.

In one embodiment, a reservoir with a substantially conical base and a substantially cylindrical top portion may be provided in a stand-alone or self-contained gravity-fed emergency shower. Such a reservoir may have greater structural strength for withstanding any vacuum pressures generated during shower use. FIG. 6A illustrates a side view of an exemplary reservoir 614 provided in accordance with another exemplary embodiment. FIG. 6B illustrates a cross-sectional side view of an exemplary gravity-fed shower 600 including the reservoir 614 of FIG. 6A, showing a section taken along A-A of FIG. 6A. The reservoir 614 may be an integral structure having a top portion that is substantially cylindrical and a base or lower portion that is substantially conical with the tip of the cone connecting to the pipe 118 that conveys water from the reservoir 614 to the shower head 112.

The stand-alone or self-contained gravity-fed emergency shower 600 may be configured so that all tubings and pipings connected to the water-tight reservoir 614 (e.g., the air-tight sealable fluid inlet 120, the air inlet pipe 126 and the air outlet pipe 134) enter the water-tight reservoir 614 through a top surface of the water-tight reservoir so that the side surfaces and the bottom surface of the water-tight reservoir may be formed as a one-piece unit, for example, by injection molding. In some examples, the water-tight reservoir may be formed of polypropylene, for example, in an injection molding process. This embodiment facilitates simpler manufacture, machining and design of the water-tight reservoir.

Figure 7:
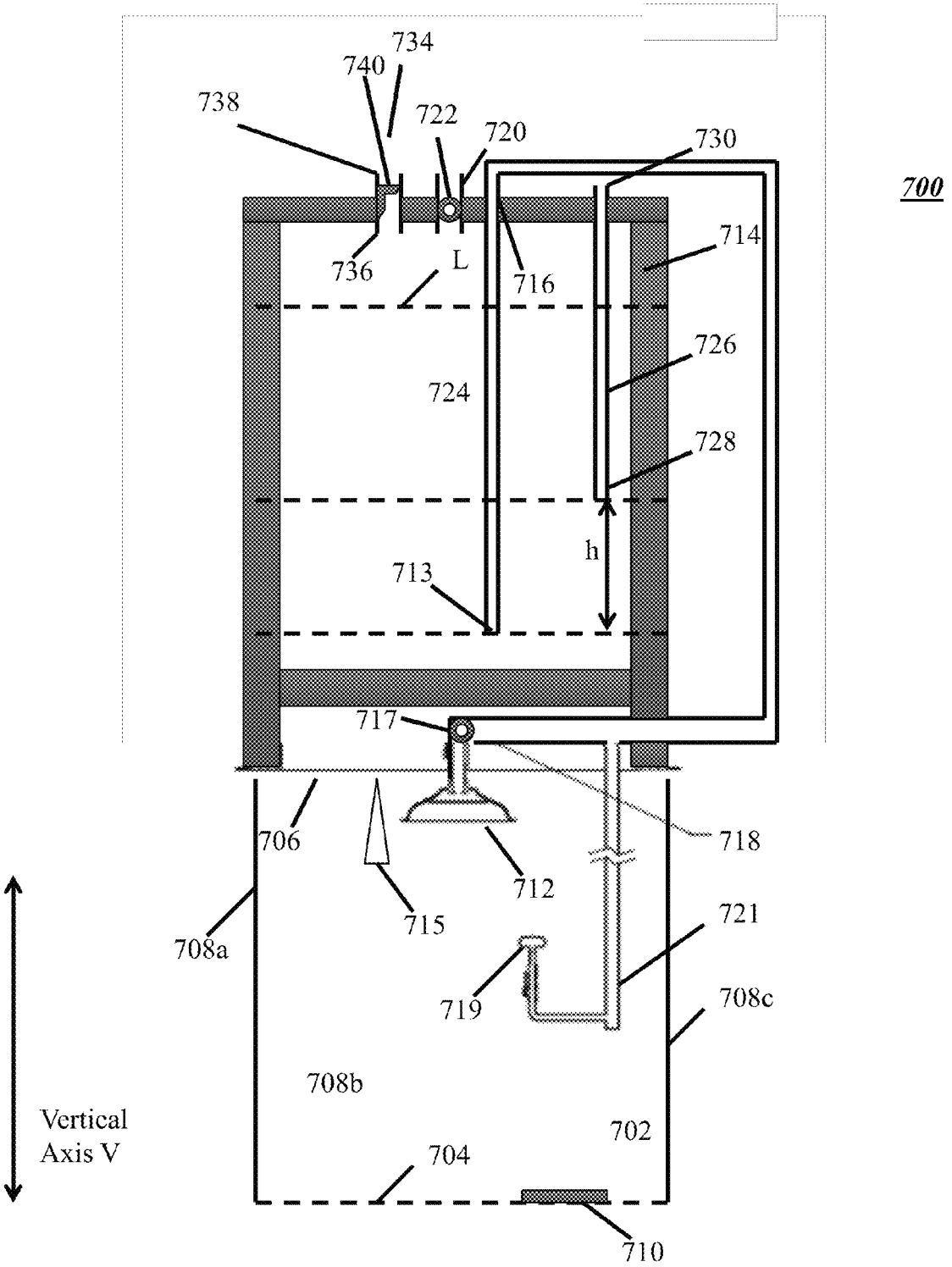
FIG. 7 is a cross-sectional side view of another exemplary gravity-fed shower including a reservoir provided in accordance with an exemplary embodiment.

FIG. 7 illustrates a cross-sectional side view of an exemplary stand-alone or self-contained gravity-fed emergency shower 700 provided in accordance with an exemplary embodiment. The stand-alone or self-contained gravity-fed emergency shower 700 is configured so that all tubings and pipings connected to the water-tight reservoir enter the water-tight reservoir through a top surface of the water-tight reservoir so that the side surfaces and the bottom surface of the water-tight reservoir may be formed as a one-piece unit, for example, by injection molding. In some examples, the water-tight reservoir may be formed of polypropylene, for example, in an injection molding process. This embodiment facilitates simpler manufacture, machining and design of the water-tight reservoir.

In some embodiments, the stand-alone or self-contained gravity-fed emergency shower 700 may include a shower stall 702 configured and dimensioned to accommodate a person within its boundaries. The shower stall 102 includes a reservoir or tank support framework. In one exemplary non-limiting embodiment, the reservoir or tank support framework of the shower stall 702 may include a floor 704 as its bottom surface, a ceiling 706 as its top surface, and walls 708*a-c* as its side surfaces. In some embodiments, the reservoir or tank support framework of the shower stall 702 may have two, three or four walls. In some non-limiting embodiments, the floor 704 may include a drain 710 for drainage of water out of the shower stall 702. In some embodiments, the reservoir or tank support framework of the shower stall 702 may not include a floor 704 or a drain 710. In some embodiments, the reservoir or tank support framework of the shower stall 702 may include a door as a fourth side surface. In some embodiments, the shower stall 702 may comprise a shower curtain.

In certain embodiments, the stand-alone or self-contained gravity-fed emergency shower 700 includes a shower head 712 mounted in the shower stall 702. The shower head 712 is arranged and positioned to be able to deliver a flow of water to a person standing in the shower stall 702. Although the shower head 712 is represented as being positioned near the ceiling 706 of the shower stall 702, the shower head 712 may enter the shower stall 702 through a side wall 708*a-c* in other embodiments. Details of an exemplary shower head and associated components that may be used in a gravity-fed shower described herein can be found in U.S. Pat. No. 8,316,478, issued Nov. 27, 2012, titled "Emergency Eyewash Unit;" U.S. Pat. No. 8,566,974, issued Oct. 29, 2013, titled "Emergency Eyewash Unit;" U.S. Pat. No. 8,747,374, issued Jun. 10, 2014, titled "Emergency Eyewash Unit;" and co-pending U.S. Patent Publication No. 2014/0047633, published Feb. 20, 2014, titled "Emergency Eyewash Unit." The entire contents of each of the patent publications referenced above are expressly incorporated herein by reference.

The stand-alone or self-contained gravity-fed emergency shower 700 includes a water-tight reservoir or tank 714 configured and dimensioned to hold a desired volume of water. In one exemplary embodiment, the water-tight reservoir or tank 714 may have an interior space with one or more sides (four sides in one example), a top surface and a bottom surface. The shower head 712 is in direct or indirect (through one or more additional components) fluid communication with the water-tight reservoir or tank 714. Upon filling, the water-tight reservoir or tank 714 contains a volume of water 724 having a fill level or height, L, which is measured from the bottom surface of the water-tight reservoir or tank 714 to the top surface of the water in the water-tight reservoir or tank 714 along the vertical axis V. The water-tight reservoir or tank 714 may be mounted above the ceiling 706 of the shower stall 702, and/or the bottom surface of the water-tight reservoir or tank 714 may form the ceiling of the shower stall 702 in some embodiments. The water-tight reservoir or tank 714 may be formed of any suitable material that can withstand any vacuum or negative pressures generated within the water-tight reservoir including, but not limited to, molded plastic and steel such as stainless steel which has anti-corrosive properties.

The exemplary reservoir or tank 714 illustrated in FIG. 7 is box-shaped with a rectangular cross-sectional profile. Water-tight reservoirs of other cross-sectional shapes and other structural designs may be used in other embodiments. In some cases, a suction or vacuum pressure may be generated within the water-tight reservoir or tank 714 as water drains out during use of the shower, creating a risk of the water-tight reservoir walls collapsing inward. In one embodiment, a substantially box-shaped reservoir may be used, as illustrated in FIG. 7. In another embodiment, a substantially cylindrical reservoir may be used. In another embodiment, a substantially spherical reservoir may be used. In another embodiment, a cylinder with a substantially conical base and a substantially spherical top may be used. Such a cylinder may have greater structural strength for withstanding any vacuum pressures generated during shower use.

In one embodiment, the water-tight reservoir or tank 714 includes a fluid outlet 716 having an interior end that is positioned below a fill level, L, of the water-tight reservoir or tank 714 and an exterior end that is in fluid communication with the shower head 712 via one or more pipes or tubes 718. In certain embodiments, the fluid outlet 716 may be attached or connected to a bottom surface of the water-tight reservoir or tank 714. In one embodiment illustrated in FIG. 7, the pipe 718 extends upward inside the water-tight reservoir or tank 714 from a terminal end 713, extends upward outside the water-tight reservoir or tank 714 through the fluid outlet 716, and then descends downwardly outside the water-tight reservoir or tank 714 to the shower head 712.

A valve 717 is provided between the shower head 712 and the exterior end of the fluid outlet 716. In one embodiment, the valve 717 may be formed of steel, such as stainless steel which has anti-corrosive properties. The valve 717 may be a ball valve in some embodiments. In one embodiment, the valve 717 may be positioned lower than the fluid outlet 716. A valve operating mechanism 715, such as a pull chain or a pull rod with a handle, is provided for opening and closing the valve 717. In certain embodiments in which the stand-alone or self-contained gravity-fed emergency shower 700 includes a shower stall 702, the valve operating mechanism 715 is located in relation to the shower stall 702 such that a person standing in the shower stall 702 can operate the valve operating mechanism 715 to open and close the valve 717. FIGS. 5A and 5B illustrate an exemplary valve that may be used as valve 717.

The water-tight reservoir or tank 714 includes an air-tight sealable fluid inlet 720 that is attached or connected to the top surface or ceiling of the water-tight reservoir or tank 714, and configured and dimensioned to allow the water-tight reservoir or tank 714 to be filled. In an alternative embodiment, the air-tight sealable fluid inlet 720 can be a removable cover of the water-tight reservoir or tank 714. In this embodiment, a rubber gasket is located between the walls and the removable cover of the water-tight reservoir or tank 714, and appropriate fasteners are used to secure the removable cover to the water-tight reservoir or tank 714. After the water-tight reservoir or tank 714 is filled, the air-tight sealable fluid inlet 720 is sealed to prevent leakage of air through the air-tight sealable fluid inlet 720. In one embodiment, an air-tight ball valve 722 is provided at the air-tight sealable fluid inlet 720 to seal the air-tight sealable fluid inlet 720.

The stand-alone or self-contained gravity-fed emergency shower 700 includes an air inlet pipe 726 having an interior end 728 extending into the water-tight reservoir or tank 714 and an exterior end 730 extending outside the water-tight reservoir or tank 714. The air inlet pipe 726 is configured and dimensioned to accommodate air flow into the interior of the water-tight reservoir or tank 714 from the exterior of the water-tight reservoir or tank 714 when the valve 717 is open. The exterior end 730 of the air inlet pipe 726 is positioned higher than the fill level, L, in the water-tight reservoir or tank 714. In some embodiments, a vented cap is attached to the exterior end 730 of the air inlet pipe 726 to prevent outside particulates from entering the water-tight reservoir or tank 714.

The interior end 728 of the air inlet pipe 726 extends into the water-tight reservoir or tank 714 to a point lower than the fill level, L, and higher than the terminal end 713 of the pipe 718. The interior end 728 of the air inlet pipe 726 is preferably positioned a distance away from the terminal end 713 of the pipe 718 to avoid air being drawn directly into the shower head 712 when the valve 717 is open.

When the valve 717 is in a closed state and when the air-tight sealable fluid inlet 720 is sealed, the air inlet pipe 726 is the only fluid conduit between the interior of the water-tight reservoir or tank 714 and the exterior of the water-tight reservoir or tank 714. That is, in this situation, the water-tight reservoir or tank 714 is air-tight except for the air that enters the water-tight reservoir or tank 714 through the air inlet pipe 726.

The amount of head pressure and hence flow rate through the shower head 712 when the valve 717 is open is determined by the height difference, h, between the opening at the interior end 728 of the air inlet pipe 726 and the terminal end 713 of the pipe 718. In the configuration of FIG. 7, since the atmospheric pressure remains constant, the head pressure at the terminal end 713 also remains substantially constant until the water drops below the opening at the interior end 728 of the air inlet pipe 726, thus maintaining a substantially constant flow rate of water discharged from the water-tight reservoir or tank 714 through the shower head 712, even as the water-tight reservoir or tank 714 drains during use of the shower without the need for a pump or a constant flow rate device or valve.

In some embodiments, the stand-alone or self-contained gravity-fed emergency shower 700 enables a user or manufacturer to adjust the flow rate of water discharged through the fluid outlet 716. Since the flow rate of water discharged through the fluid outlet 716 depends on the head pressure at the terminal end 713 of the pipe 718 relative to the interior end 728 of the air inlet pipe 726, and since this head pressure depends on the vertical distance or height between the interior end 728 and the terminal end 713, adjustment of the flow rate is enabled by enabling adjustment of the height of the interior end 728 of the air inlet pipe 726 within the water-tight reservoir or tank 714 (i.e., the height along the vertical axis V of the interior end 728 relative to the bottom surface of the water-tight reservoir or tank 714). This height may be decreased by moving the air inlet pipe 726 downward along the vertical axis V farther into the water-tight reservoir or tank 714, and may be increased by moving the air inlet pipe 726 upward along the vertical axis V farther out of the water-tight reservoir or tank 714. A pipe movement and locking mechanism may be provided to enable movement of the air inlet pipe 726 along the vertical axis V and to lock it in place at a desired height. When the height of the interior end 728 is decreased, head pressure at the terminal end 713 of the pipe 718 is decreased as well, causing a decrease in the flow rate of water discharged through the fluid outlet 716. Similarly, when the height of the interior end 728 is increased, head pressure at the fluid outlet 716 is increased as well, causing an increase in the flow rate of water discharged through the fluid outlet 716.

In some embodiments, the water-tight reservoir or tank 714 includes an air outlet pipe 734 as an air escape vent that is attached or connected to the top surface or ceiling of the water-tight reservoir. The air outlet pipe 734 is preferably positioned as close as possible to the top surface of the water-tight reservoir or tank 714 and, in some cases, through the top surface to allow maximum filling of the water-tight reservoir or tank 714 and to minimize the size of the air pocket at the top of the water-tight reservoir or tank 714. The air outlet pipe 734 includes an interior end 736 positioned higher than the fill level, L, and an exterior end 738 extending out of the water-tight reservoir or tank 714 higher than the fill level. A one-way check valve 740 is provided or attached at the air outlet pipe 734 to allow air flow from the interior of the water-tight reservoir or tank 714 to the exterior of the water-tight reservoir or tank 714 when water is introduced into the water-tight reservoir through the air-tight sealable fluid inlet 720. This helps establish a vacuum in the water-tight reservoir or tank 714 that is important in controlling the flow rate of the water out of the water-tight reservoir or tank 714. The one-way check valve 740 operates to prevent air flow from the exterior of the water-tight reservoir or tank 714 to the interior of the water-tight reservoir or tank 714, thus ensuring that the drainage of water through the fluid outlet 716 creates a suction effect within the water-tight reservoir or tank 714.

In certain non-limiting embodiments, the stand-alone or self-contained gravity-fed emergency shower 700 may include or be used in cooperation with an emergency eyewash apparatus 719 used to flush contaminants from the eyes of a user using the stand-alone or self-contained gravity-fed emergency shower 700. The emergency eyewash apparatus 719 is in fluid communication with the fluid outlet 716 of the water-tight reservoir or tank 714, for example, via one or more pipes 721 that is in fluid communication with the fluid outlet 716. In one example, when the valve 717 is in a closed state, the pipes 718 and 721 do not receive any water from the water-tight reservoir or tank 714 and, consequently, the shower head 712 and the eyewash apparatus 719 do not discharge any water to the user. When the valve 717 is in an open or activated state, water flows out of the water-tight reservoir or tank 714 through the fluid outlet 716 and into pipes 718 and 721, thereby enabling both the shower head 712 and the eyewash apparatus 719 to concurrently discharge water to the user. This enables the user of the stand-alone or self-contained gravity-fed emergency shower 700 to wash contaminants from both his body and his eyes at the same time.

In one embodiment, the emergency eyewash apparatus includes two water discharge ports configured to be directed upward along the vertical plane and to diverge from each other, thereby producing a pair of upwardly directed diverging water streams for inside-out flush flow of contaminants from the eyes. The inside-out flush flow flushes contaminants away from the inner corner of the eyes away from the lacrimal punctum and toward the outer corner of the eyes. In certain embodiments, the emergency eyewash apparatus may include one or more face wash discharge ports that produce a plurality of water streams for washing contaminants from the face.

Details of an exemplary emergency eyewash apparatus that may be used in a gravity-fed shower described herein can be found in U.S. Pat. No. 8,316,478, issued Nov. 27, 2012, titled "Emergency Eyewash Unit;" U.S. Pat. No. 8,566,974, issued Oct. 29, 2013, titled "Emergency Eyewash Unit;" U.S. Pat. No. 8,747,374, issued Jun. 10, 2014, titled "Emergency Eyewash Unit;" co-pending U.S. Patent Publication No. 2014/0047633, published Feb. 20, 2014, titled "Emergency Eyewash Unit;" and co-pending U.S. Patent Publication No. 2012/0096639, published Apr. 26, 2012, titled "Faucet Mounted Eyewash Unit." The entire contents of each of the patent publications referenced above are expressly incorporated herein by reference.

Prior to use of the exemplary stand-alone or self-contained gravity-fed emergency shower 700, the water-tight reservoir or tank 714 is filled with water via the air-tight sealable fluid inlet 720. During the filling process, the one-way check valve 740 allows air in the water-tight reservoir or tank 714 to escape via the air outlet pipe 734. After the water-tight reservoir or tank 714 is filled with water, the ball valve 722 is used to seal the air-tight sealable fluid inlet 720 to prevent drainage or leakage of water out of the water-tight reservoir or tank 714 through the air-tight sealable fluid inlet 720. At the same time, the one-way check valve 740 prevents air from entering the water-tight reservoir or tank 714, thus maintaining a suction or vacuum pressure within the water-tight reservoir or tank 714 when the water is drained.

A user may activate the stand-alone or self-contained gravity-fed emergency shower 700 using the valve operating mechanism 715 to open the valve 717. Water from the water-tight reservoir or tank 714 is discharged through the fluid outlet 716 through the pipe 718 and into the shower head 712. The discharge of the water may increase the suction or vacuum pressure in the water-tight reservoir or tank 714 in certain situations, thus drawing in air into the water-tight reservoir or tank 714 through the exterior end 730 of the air inlet pipe 726 from the exterior of the water-tight reservoir or tank 714. The air inlet pipe 726 is the only means for ambient air to enter the water-tight reservoir or tank 714. The flow rate of water through the terminal end 713 of the pipe 718 is determined by the head pressure at the terminal end 713 relative to the interior end 728 of the air inlet pipe 726. In the configuration of FIG. 7, since the atmospheric pressure remains constant, the head pressure at the terminal end 713 of the pipe 718 also remains substantially constant, thus maintaining a substantially constant flow rate of water discharged from the water-tight reservoir or tank 714 through the fluid outlet 716.

Figure 8:
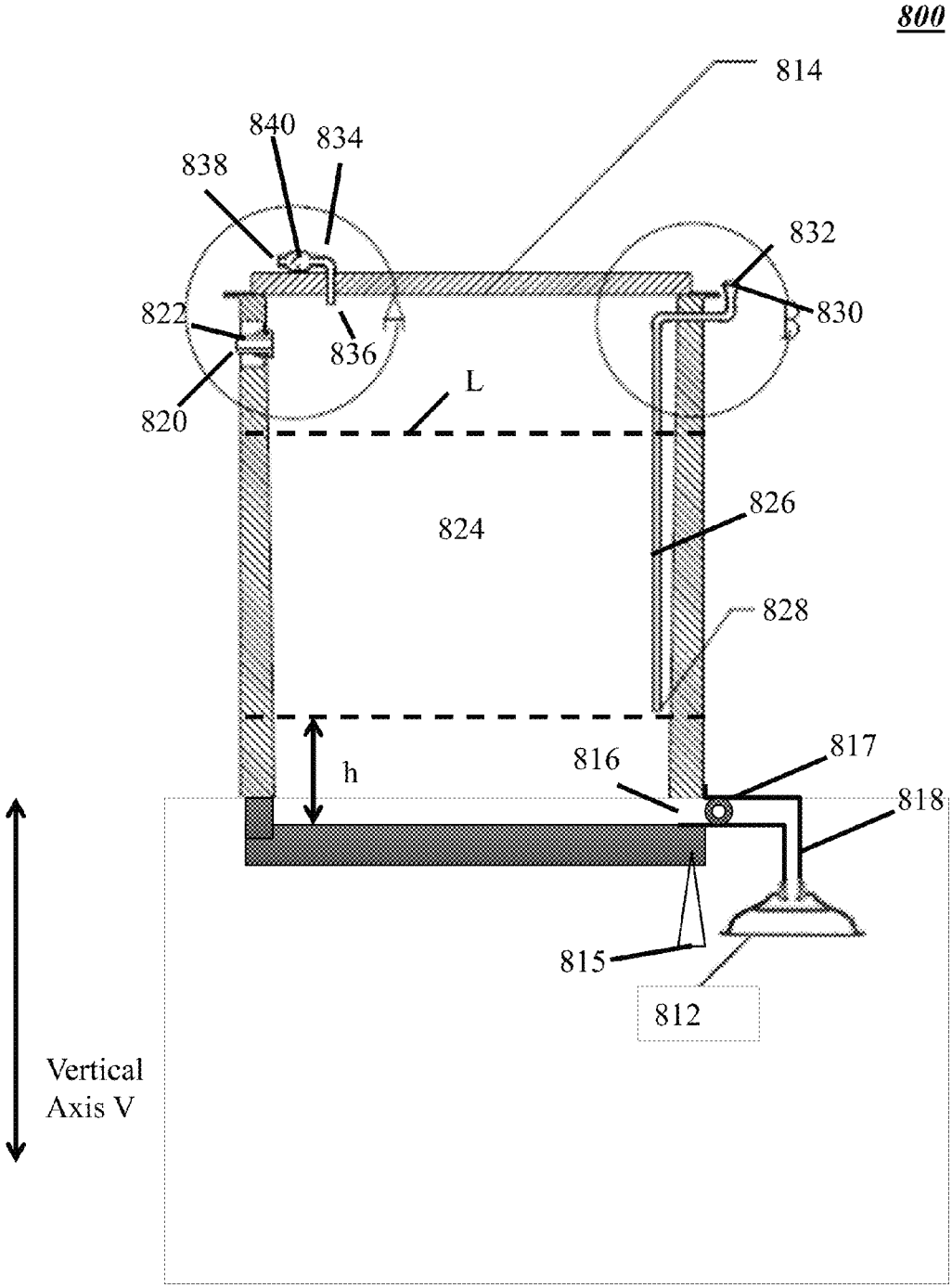
FIG. 8 is a cross-sectional side view of another exemplary gravity-fed shower including a reservoir provided in accordance with an exemplary embodiment.

FIG. 8 illustrates a cross-sectional side view of an exemplary stand-alone or self-contained gravity-fed emergency shower 800 provided in accordance with an exemplary embodiment. The exemplary stand-alone or self-contained gravity-fed emergency shower 800 includes a water-tight reservoir or tank 814 but is free of a shower stall. In one exemplary embodiment, the water-tight reservoir or tank 814 may have an interior space with one or more sides (four sides in one example), a top surface and a bottom surface. The water-tight reservoir or tank 814 is configured to be mounted on any suitable reservoir support surface or framework, for example, on the ceiling of a shower stall, for use as a shower. Upon filling, the water-tight reservoir or tank 814 contains a volume of water 824 having a fill level or height, L, which is measured from the bottom surface of the water-tight reservoir or tank 814 to the top surface of the water in the water-tight reservoir or tank 814 along the vertical axis V. The water-tight reservoir or tank 814 may be formed of any suitable material that can withstand any vacuum or negative pressures generated within the water-tight reservoir including, but not limited to, molded plastic and steel such as stainless steel which has anti-corrosive properties.

The exemplary water-tight reservoir or tank 814 illustrated in FIG. 8 is box-shaped with a rectangular cross-sectional profile. Water-tight reservoirs of other cross-sectional shapes and other structural designs may be used in other embodiments. In some cases, a suction or vacuum pressure may be generated within the water-tight or tank reservoir or tank 814 as water drains out during use of the shower, creating a risk of the water-tight reservoir walls collapsing inward. In one embodiment, a substantially box-shaped reservoir may be used, as illustrated in FIG. 8. In another embodiment, a substantially cylindrical reservoir may be used. In another embodiment, a substantially spherical reservoir may be used. In another embodiment, a cylinder with a substantially conical base and a substantially spherical top may be used. Such a cylinder may have greater structural strength for withstanding any vacuum pressures generated during shower use.

In certain embodiments, the water-tight reservoir or tank 814 is in direct or indirect (through one or more additional components) fluid communication with a shower head 812. In one embodiment, the shower head 812 is mounted at a bottom surface or at a lower portion of a side surface of the water-tight reservoir or tank 814. The shower head 812 is arranged and positioned to be external to the water-tight reservoir or tank 814 and able to deliver a flow of water from the water-tight reservoir or tank 814 to a person positioned in the proximity of the water-tight reservoir or tank 814. Details of an exemplary shower head and associated components that may be used in a gravity-fed shower described herein can be found in U.S. Pat. No. 8,316,478, issued Nov. 27, 2012, titled "Emergency Eyewash Unit;" U.S. Pat. No. 8,566,974, issued Oct. 29, 2013, titled "Emergency Eyewash Unit;" U.S. Pat. No. 8,747,374, issued Jun. 10, 2014, titled "Emergency Eyewash Unit;" and co-pending U.S. Patent Publication No. 2014/0047633, published Feb. 20, 2014, titled "Emergency Eyewash Unit." The entire contents of each of the patent publications referenced above are expressly incorporated herein by reference.

In one embodiment, the water-tight reservoir or tank 814 includes a fluid outlet 816 having an interior end that is positioned below a fill level, L, of the water-tight reservoir or tank 814 and an exterior end that is in fluid communication with the shower head 812 via one or more pipes or tubes 818. In certain embodiments, the fluid outlet 816 may be attached or connected to a bottom surface of the water-tight reservoir or tank 814. In one embodiment illustrated in FIG. 8, the pipe 818 extends downward from the fluid outlet 816 to the shower head 812. In another embodiment, the pipe 818 may be configured as a siphon so that it extends from the fluid outlet 816 upward to a position above the fill level, L, and then downward to the shower head 812.

A valve 817 is provided between the shower head 812 and the exterior end of the fluid outlet 816. In one embodiment, the valve 817 may be positioned lower than the fluid outlet 816. In one embodiment, the valve may be formed of steel, such as stainless steel which has anti-corrosive properties. The valve 817 may be a ball valve in some embodiments. A valve operating mechanism 815, such as a pull chain or a pull rod with a handle, is provided for opening and closing the valve 817. FIGS. 5A and 5B illustrate an exemplary valve that may be used as valve 817.

The water-tight reservoir or tank 814 includes an air-tight sealable fluid inlet 820 configured and dimensioned to allow the water-tight reservoir or tank 814 to be filled. In an alternative embodiment, the air-tight sealable fluid inlet 820 can be a removable cover of the water-tight reservoir or tank 814. In this embodiment, a rubber gasket is located between the walls and the removable cover of the water-tight reservoir or tank 814, and appropriate fasteners are used to secure the removable cover to the water-tight reservoir or tank 814. After the water-tight reservoir or tank 814 is filled, the air-tight sealable fluid inlet 820 is sealed to prevent leakage of air through the air-tight sealable fluid inlet 820. In one embodiment, an air-tight ball valve 822 is provided at the air-tight sealable fluid inlet 820 to seal the air-tight sealable fluid inlet 820.

The water-tight reservoir or tank 814 includes an air inlet pipe 826 having an interior end 828 extending into the water-tight reservoir or tank 814 and an exterior end 830 extending outside the water-tight reservoir or tank 814. The air inlet pipe 826 is configured and dimensioned to accommodate air flow into the interior of the water-tight reservoir or tank 814 from the exterior of the water-tight reservoir or tank 814 when the valve 817 is open. The exterior end 830 of the air inlet pipe 826 is positioned higher than the fill level, L, in the water-tight reservoir or tank 814. In some embodiments, a vented cap 832 is attached to the exterior end 830 of the air inlet pipe 826 to prevent outside particulates from entering the water-tight reservoir or tank 814.

The interior end 828 of the air inlet pipe 826 extends into the water-tight reservoir or tank 814 to a point lower than the fill level, L, and higher than the fluid outlet 816 of the water-tight reservoir or tank 814. The interior end 828 of the air inlet pipe 826 is preferably positioned a distance away from the fluid outlet 816 to avoid air being drawn directly into the shower head 812 when the valve 817 is open.

When the valve 817 is in a closed state and when the air-tight sealable fluid inlet 820 is sealed, the air inlet pipe 826 is the only fluid conduit between the interior of the water-tight reservoir or tank 814 and the exterior of the water-tight reservoir or tank 814. That is, in this situation, the water-tight reservoir or tank 814 is air-tight except for the air that enters the water-tight reservoir or tank 814 through the air inlet pipe 826.

The amount of head pressure and hence flow rate through the shower head 812 when the valve 817 is open is determined by the height difference, h, between the opening at the interior end 828 of the air inlet pipe 826 and the fluid outlet 816. In the configuration of FIG. 8, since the atmospheric pressure remains constant, the head pressure at the fluid outlet 816 also remains substantially constant until the water drops below the opening at the interior end 828 of the air inlet pipe 826, thus maintaining a substantially constant flow rate of water discharged from the water-tight reservoir or tank 814 through the fluid outlet 816, even as the water-tight reservoir or tank 814 drains during use of the shower without the need for a pump or a constant flow rate device or valve.

In some embodiments, the stand-alone or self-contained gravity-fed emergency shower 800 enables a user or manufacturer to adjust the flow rate of water discharged through the fluid outlet 816. Since the flow rate of water discharged through the fluid outlet 816 depends on the head pressure at the fluid outlet 816 relative to the interior end 828 of the air inlet pipe 826, and since this head pressure depends on the vertical distance or height between the interior end 828 and the fluid outlet 816, adjustment of the flow rate is enabled by enabling adjustment of the height of the interior end 828 of the air inlet pipe 826 within the water-tight reservoir or tank 814 (i.e., the height along the vertical axis V of the interior end 828 relative to the bottom surface of the water-tight reservoir or tank 814). This height may be decreased by moving the air inlet pipe 826 downward along the vertical axis V farther into the water-tight reservoir or tank 814, and may be increased by moving the air inlet pipe 826 upward along the vertical axis V farther out of the water-tight reservoir or tank 814. A pipe movement and locking mechanism may be provided to enable movement of the air inlet pipe 826 along the vertical axis V and to lock it in place at a desired height. When the height of the interior end 828 is decreased, head pressure at the fluid outlet 816 is decreased as well, causing a decrease in the flow rate of water discharged through the fluid outlet 816. Similarly, when the height of the interior end 828 is increased, head pressure at the fluid outlet 816 is increased as well, causing an increase in the flow rate of water discharged through the fluid outlet 816.

In some embodiments, the water-tight reservoir or tank 814 includes an air outlet pipe 834 as an air escape vent attached or connected to either the ceiling or at a top portion of one of the surfaces of the water-tight reservoir or tank 814. The air outlet pipe 834 is preferably positioned as close as possible to the top surface of the water-tight reservoir or tank 814 and, in some cases, through the top surface to allow maximum filling of the water-tight reservoir or tank 814 and to minimize the size of the air pocket at the top of the water-tight reservoir or tank 814. The air outlet pipe 834 includes an interior end 836 positioned higher than the fill level, L, and an exterior end 838 extending out of the water-tight reservoir or tank 814 higher than the fill level. A one-way check valve 840 is provided or attached at the air outlet pipe 834 to allow air flow from the interior of the water-tight reservoir or tank 814 to the exterior of the water-tight reservoir or tank 814 when water is introduced into the water-tight reservoir or tank 814 through the air-tight sealable fluid inlet 820. This helps establish a vacuum in the water-tight reservoir or tank 814 that is important in controlling the flow rate of the water out of the water-tight reservoir or tank 814. The one-way check valve 840 operates to prevent air flow from the exterior of the water-tight reservoir or tank 814 to the interior of the water-tight reservoir or tank 814, thus ensuring that the drainage of water through the fluid outlet 816 creates a suction effect within the water-tight reservoir or tank 814.

Prior to use of the exemplary stand-alone or self-contained gravity-fed emergency shower 800, the water-tight reservoir or tank 814 is filled with water via the air-tight sealable fluid inlet 820. During the filling process, the one-way check valve 840 allows air in the water-tight reservoir or tank 814 to escape via the air outlet pipe 834. After the water-tight reservoir or tank 814 is filled with water, the ball valve 822 is used to seal the air-tight sealable fluid inlet 820 to prevent drainage or leakage of water out of the water-tight reservoir or tank 814 through the air-tight sealable fluid inlet 820. At the same time, the one-way check valve 840 prevents air from entering the water-tight reservoir or tank 814, thus maintaining a suction or vacuum pressure within the water-tight reservoir or tank 814 when the water is drained.

A user may activate the stand-alone or self-contained gravity-fed emergency shower 800 using the valve operating mechanism 815 to open the valve 817. Water from the water-tight reservoir or tank 814 is discharged through the fluid outlet 816 through the pipe 818 and into the shower head 812. The discharge of the water may increase the suction or vacuum pressure in the water-tight reservoir or tank 814 in certain situations, thus drawing in air into the water-tight reservoir or tank 814 through the exterior end 830 of the air inlet pipe 826 from the exterior of the water-tight reservoir or tank 814. The air inlet pipe 826 is the only means for ambient air to enter the water-tight reservoir or tank 814. The flow rate of water through the fluid outlet 816 is determined by the head pressure at the fluid outlet 816 relative to the interior end 828 of the air inlet pipe 826. In the configuration of FIG. 8, since the atmospheric pressure remains constant, the head pressure at the fluid outlet 816 also remains substantially constant, thus maintaining a substantially constant flow rate of water discharged from the water-tight reservoir or tank 814 through the fluid outlet 816.

In describing exemplary embodiments, specific terminology is used for the sake of clarity. For purposes of description, each specific term is intended to, at least, include all technical and functional equivalents that operate in a similar manner to accomplish a similar purpose. Additionally, in some instances where a particular exemplary embodiment includes a plurality of system elements or method steps, those elements or steps may be replaced with a single element or step. Likewise, a single element or step may be replaced with a plurality of elements or steps that serve the same purpose. Further, where parameters for various properties are specified herein for exemplary embodiments, those parameters may be adjusted up or down by 1/20th, 1/10th, 1/5th, 1/3rd, 1/2nd, and the like, or by rounded-off approximations thereof, unless otherwise specified. Moreover, while exemplary embodiments have been shown and described with references to particular embodiments thereof, those of ordinary skill in the art will understand that various substitutions and alterations in form and details may be made therein without departing from the scope of the invention. Further still, other aspects, functions and advantages are also within the scope of the invention.

Exemplary flowcharts are provided herein for illustrative purposes and are non-limiting examples of methods. One of ordinary skill in the art will recognize that exemplary methods may include more or fewer steps than those illustrated in the exemplary flowcharts, and that the steps in the exemplary flowcharts may be performed in a different order than shown.

Blocks of the block diagram and the flow chart illustrations support combinations of means for performing the specified functions, combinations of steps for performing the specified functions and program instruction means for performing the specified functions. It will also be understood that some or all of the blocks/steps of the circuit diagram and process flowchart, and combinations of the blocks/steps in the circuit diagram and process flowcharts, can be implemented by special purpose hardware-based computer systems that perform the specified functions or steps, or combinations of special purpose hardware and computer instructions. Exemplary systems may include more or fewer modules than those illustrated in the exemplary block diagrams.

Many modifications, combinations and other embodiments of the inventions set forth herein will come to mind to one skilled in the art to which these embodiments of the invention pertain having the benefit of the teachings presented in the foregoing descriptions and the associated drawings. Therefore, it is to be understood that the embodiments of the invention are not to be limited to the specific embodiments disclosed and that modifications, combinations and other embodiments are intended to be included within the scope of the appended claims. Although specific terms are employed herein, they are used in a generic and descriptive sense only and not for purposes of limitation.

What is claimed is:

1. A self-contained emergency shower, comprising:

a shower stall comprising a tank supporting framework;

a water-tight reservoir mounted on the tank supporting framework, the water-tight reservoir including an air-tight sealable fluid inlet port, a fluid outlet having a fluid outlet interior end and a fluid outlet exterior end, and an ambient air inlet pipe, wherein the fluid outlet exterior end is in fluid communication with a shower head;

a valve located between the shower head and the fluid outlet exterior end; and a valve operating mechanism for opening and closing the valve;

wherein the ambient air inlet pipe of the water-tight reservoir includes an interior end and an exterior end, the interior end extending into the water-tight reservoir to a distance above the fluid outlet interior end; wherein the distance is configured to provide a constant flow rate of liquid discharged from the water-tight reservoir through the fluid outlet exterior end;

wherein the exterior end of the ambient air inlet pipe extends outside a side wall of the water-tight reservoir; and wherein, when the valve is in a closed state and the fluid inlet port is sealed, the ambient air inlet pipe is the only fluid conduit between the interior of the water-tight reservoir and the exterior of the water-tight reservoir.

2. The self-contained emergency shower of claim 1 wherein the tank supporting framework includes at least one side wall.

3. The self-contained emergency shower of claim 1, wherein the fluid outlet is positioned above a fill level of the water-tight reservoir and the fluid outlet interior end is connected to a first end of a tube and a second end of the tube is positioned below the fill level, and the shower head is positioned below the second end of the tube.

4. The self-contained emergency shower of claim 1 wherein the distance between the interior end of the ambient air inlet pipe and the fluid outlet interior end is between 8 and 11 inches.

5. The self-contained emergency shower of claim 1 wherein the constant flow rate is maintained until the liquid in the water-tight reservoir drops below the interior end of the ambient air inlet pipe.

6. A stand-alone emergency shower, comprising:

a shower stall comprising a ceiling and three walls;

a shower head mounted in the shower stall, the shower head arranged to be able to deliver water to a person positioned in the shower stall;

a water-tight reservoir having an interior mounted above the shower stall, the water-tight reservoir including an air-tight sealable fluid inlet port, an outlet port and an ambient air inlet pipe, the outlet port positioned higher than the shower head, and a tube connecting the outlet port to the shower head;

a valve connected to the tube and located between the shower head and the outlet port of the water-tight reservoir, the valve positioned below than the outlet port; and a valve operating mechanism for opening and closing the valve, the valve operating mechanism located in relation to the shower stall such that a person positioned in the shower stall can open and close the valve using the valve operating mechanism;

wherein the ambient air inlet pipe of the water-tight reservoir includes an interior end and an exterior end, the interior end extending into the water-tight reservoir to a distance above the fluid outlet interior end; wherein the distance is configured to provide a constant flow rate of liquid discharged from the water-tight reservoir through the fluid outlet exterior end;

wherein the exterior end of the ambient air inlet pipe extends outside a side wall of the water-tight reservoir; and wherein, when the valve is in a closed state and the fluid inlet port is sealed, the ambient air inlet pipe is the only fluid conduit to the interior of the water-tight reservoir.

7. The stand-alone emergency shower of claim 6, wherein the bottom of the water-tight reservoir forms the ceiling of the shower stall.

8. The stand-alone emergency shower of claim 6, further comprising:

a vented cap attached to the exterior end of the ambient air inlet pipe.

9. The stand-alone emergency shower of claim 6, further comprising:

a valve disposed at the fluid inlet port.

10. The stand-alone emergency shower of claim 6, further comprising:

an air outlet pipe provided at the water-tight reservoir, the air outlet pipe including an interior end positioned higher than the fill level and an exterior end extending out of the water-tight reservoir higher than the fill level; and a one-way check valve disposed at the air outlet pipe, the one-way check valve configured to allow air flow from the interior of the water-tight reservoir to the exterior of the water-tight reservoir when water is introduced into the water-tight reservoir through the air-tight sealable fluid inlet port, the one-way check valve configured to prevent air flow from the exterior of the water-tight reservoir to the interior of the water-tight reservoir.

11. The stand-alone emergency shower of claim 6, further comprising:

an emergency eyewash apparatus including a pair of water discharge ports;

wherein the valve is connected to the tube between the emergency eyewash apparatus and the outlet port of the water-tight reservoir.

12. A stand-alone emergency shower, comprising:

a tank, the tank having an interior, one or more sides, a top and a bottom, and including a shower head, an air-tight sealable fluid inlet port, an outlet port and an ambient air inlet pipe, the outlet port positioned below the top of the tank and higher than the shower head, the outlet port in fluid communication with the shower head;

a valve located between the shower head and the outlet port of the tank, the valve positioned lower than the outlet port; and a valve operating mechanism for opening and closing the valve;

wherein the ambient air inlet pipe of the tank includes an interior end and an exterior end, the interior end extending into the tank to a distance above the outlet port; wherein the distance is configured to provide a constant flow rate of liquid discharged from the tank through the outlet port;

wherein the exterior end of the ambient air inlet pipe extends outside a side wall of the tank; and wherein, when the valve is in a closed state and the fluid inlet port is sealed, the ambient air inlet pipe is the only fluid inlet to the interior of the tank.

13. The stand-alone emergency shower of claim 12, further comprising:

a shower stall;

wherein the tank is mounted above the shower stall.

14. The stand-alone emergency shower of claim 12, wherein the outlet port is attached to the one or more sides of the tank.

15. The stand-alone emergency shower of claim 12, further comprising:

a vent cap attached to the exterior end of the ambient air inlet pipe.

16. The stand-alone emergency shower of claim 12, further comprising:

a valve attached to the fluid inlet port.

17. The stand-alone emergency shower of claim 12, further comprising:

an air outlet pipe at the tank, the air outlet pipe including an interior end positioned higher than a fill level of the tank and an exterior end extending out of the tank higher than the fill level; and a one-way check valve disposed at the air outlet pipe, the one-way check valve configured to allow air flow from the interior of the tank to the exterior of the tank when water is introduced into the tank through the fluid inlet port, the one-way check valve configured to prevent air flow from the exterior of the tank to the interior of the tank.

18. The stand-alone emergency shower of claim 12, wherein the distance between the interior end of the ambient air inlet pipe and outlet port is between 8 and 11 inches.

19. The stand-alone emergency shower of claim 12, wherein the constant flow rate is maintained until the liquid in the tank reservoir drops below the interior end of the ambient air inlet pipe.

* * * * *